US007117908B1

(12) United States Patent
Coron

(10) Patent No.: US 7,117,908 B1
(45) Date of Patent: Oct. 10, 2006

(54) PROPANE TANK COVERING DEVICE

(76) Inventor: Mark Coron, 2115 Hwy. D, Lac Du Flambeau, WI (US) 54538

( * ) Notice: Subject to any disclaimer, the term of this patent is extended or adjusted under 35 U.S.C. 154(b) by 419 days.

(21) Appl. No.: 10/623,838

(22) Filed: Jul. 22, 2003

(51) Int. Cl.
*B65D 85/00* (2006.01)

(52) U.S. Cl. ..... 150/154

(58) Field of Classification Search ..... None
See application file for complete search history.

(56) References Cited

U.S. PATENT DOCUMENTS

| | | | | |
|---|---|---|---|---|
| 2,080,728 | A | 5/1937 | MacNeill et al. | |
| 4,039,098 | A | 8/1977 | Stilts | |
| 4,301,828 | A | 11/1981 | Martin, Jr. | |
| 4,905,855 | A | 3/1990 | Troiano et al. | |
| 5,172,795 | A * | 12/1992 | Riceman | 190/26 |
| 5,423,586 | A | 6/1995 | Fuller | |
| 5,638,858 | A | 6/1997 | Gettinger et al. | |
| 6,012,411 | A | 1/2000 | Hochbrueckner | |
| D428,554 | S | 7/2000 | Phelps | |
| 6,119,718 | A * | 9/2000 | Cappuccio | 137/382 |
| D460,145 | S * | 7/2002 | Johnson | D23/206 |
| 6,508,282 | B1 * | 1/2003 | Garofalo et al. | 150/154 |

* cited by examiner

*Primary Examiner*—Stephen Castellano

(57) ABSTRACT

A propane tank covering device includes a first end wall, a second end wall and a peripheral wall extending between and being attached to the first and second end walls. The first end wall, the second end wall and the peripheral wall each comprise a flexible material. The peripheral wall has a bottom opening therein. The bottom opening is elongated and generally extends from the first end wall to the second end wall. The peripheral wall has a top opening therein. The top opening is positioned opposite of the bottom opening. The top opening is generally centrally located between the first and second end walls. The present invention is positioned over an above ground propane storage tank to enhance the appearance thereof.

9 Claims, 3 Drawing Sheets

PROPANE TANK COVERING DEVICE

BACKGROUND OF THE INVENTION

1. Field of the Invention

The present invention relates to tank coverings and more particularly pertains to a new tank covering for enhancing the appearance of an above ground propane storage tank.

2. Description of the Prior Art

The use of tank coverings is known in the prior art. While these devices fulfill their respective, particular objectives and requirements, the need remains for a device that covers propane storage tanks. These generally large items often become rusted and discolored with age even though they continue to be in good working condition. For this reason, a covering is needed that enhances the appearance of such storage tanks.

SUMMARY OF THE INVENTION

The present invention meets the needs presented above by providing a covering having a size and shape adapted for retrofitting to existing propane storage tanks.

Another object of the present invention is to provide a new tank covering that includes an top opening to expose a gauge and fill point of the storage tank.

To this end, the present invention generally comprises a first end wall, a second end wall and a peripheral wall extending between and being attached to the first and second end walls. The first end wall, the second end wall and the peripheral wall each comprise a flexible material. The peripheral wall has a bottom opening therein. The bottom opening is elongated and generally extends from the first end wall to the second end wall. The peripheral wall has a top opening therein. The top opening is positioned opposite of the bottom opening. The top opening is generally centrally located between the first and second end walls. The present invention is positioned over an above ground propane storage tank to enhance the appearance thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
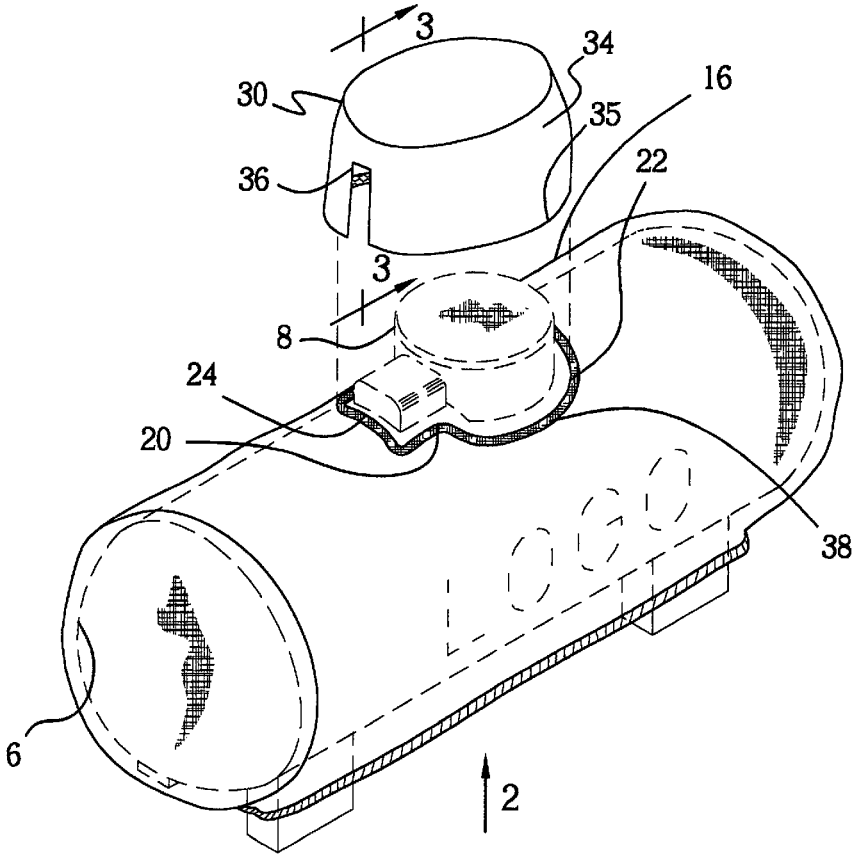
FIG. 1 is a schematic perspective view of a propane tank covering device according to the present invention.
Figure 2:
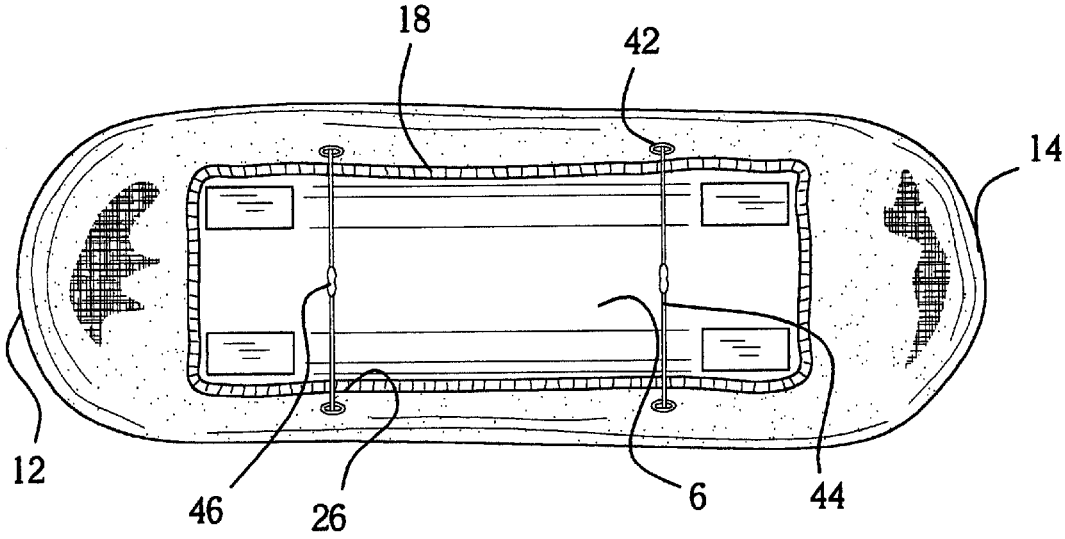
FIG. 2 is a schematic bottom view of the present invention.
Figure 3:
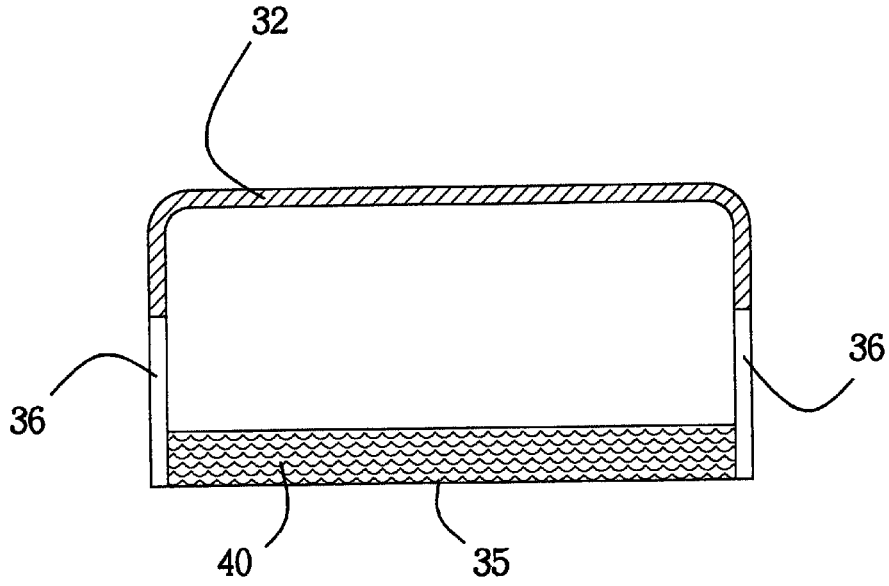
FIG. 3 is a schematic cross-sectional view taken along line 3—3 of FIG. 1 of the present invention.

With reference now to the drawings, and in particular to FIGS. 1 through 3 thereof, a new tank covering embodying the principles and concepts of the present invention and generally designated by the reference numeral 10 will be described.

As best illustrated in FIGS. 1 through 3, the propane tank covering device 10 generally comprises a device 10 which is used for positioning over an above ground propane storage tank 6. Such storage tanks 6 typically store several hundred gallons of liquid propane and include a gauge and filler area 8 along a top side of the storage tank 6.

The device 10 includes a first end wall 12, a second end wall 14 and a peripheral wall 16 that extends between and is attached to the first 12 and second 14 end walls. The first end wall 12, the second end wall 14 and the peripheral wall 16 each comprises a flexible material. The flexible material is preferably a canvas material, a plastic material or a combination of such, though any type of fabric may also be used. The peripheral wall 16 has a bottom opening 18 therein. The bottom opening 18 is elongated and generally extends from the first end wall 12 to the second end wall 14. The bottom opening 18 preferably has a generally rectangular shape and preferably has a length greater than five feet and a width generally between two feet and four feet. The peripheral wall 16 also has a top opening 20 therein. The top opening 20 is positioned opposite of the bottom opening 18 and is generally centrally located between the first 12 and second 14 end walls. The top opening 20 has a size and shape for selectively receiving a gauge and filling point 8 of the propane storage tank 6. This shape preferably includes a circular portion 22 and a rectangular portion 24. The first 12 and second 14 end walls each have a generally circular shape. Each of the first 12 and second 14 end walls preferably has a diameter generally between three feet and five feet. The peripheral wall 18 has a length from the first end wall 12 to the second end wall 14 generally between seven feet and ten feet. Though the dimensions mentioned are considered optimal, they may be varied depending on the size of the storage tank 6 to be covered.

The device may include a cover 30 for positioning over the gauge and filler area 8. Preferably, the cover 30 includes a top wall 32 and a perimeter wall 34 being attached to and extending downwardly from the top wall 32. The perimeter wall 34 has a bottom edge 35 preferably having at least one and more preferably two slit 36 extending upwardly therefrom for access to the filler area 8 when the cover 30 is positioned on such. A fastening assembly removably fastens the cover 30 to an edge of the top opening 20. The fastening assembly preferably includes a hook and loop assembly having a first mating portion 38 attached to and extending around the top opening and a second mating portion 40 attached to and extending around and inner surface of the perimeter wall 34 and being positioned adjacent to the bottom edge 35.

Preferably, a resiliently elastic member 26 is attached to and extends along a length of a peripheral edge of the bottom opening 18. When the device 10 is positioned on the storage tank 6, the elastic member 26 ensures that the device 10 remains on the storage tank 6.

For greater stability of the device 10, grommets 42 may be positioned in the peripheral wall 16 for receiving elongated cords 44 that are extendable across the bottom opening

18. The cords 44 preferably include clasps 46 for removing the device from the tank 6 though they may also be tied in position.

In use, the device 10 is positioned over a storage tank 6 as shown in FIG. 1. The flexible nature of the device 10 allows it to conform to the shape of the storage tank 6. The device 10 provides a more attractive appearance of the storage tank 6. Preferably, an outer surface of the first end 12, second end 14 and peripheral 16 walls of the device 10 are decorated with a color scheme, logos, artwork, designs, or all of these to enhance the appearance of the storage tank 6.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An above ground propane storage tank covering device, said device comprising:

a first end wall, a second end wall and a peripheral wall extending between and being attached to said first and second end walls, said first end wall, said second end wall and said peripheral wall comprising a flexible material, said peripheral wall having a bottom opening therein, said bottom opening being elongated and having a width and generally extending from said first end wall to said second end wall, said peripheral wall having a top opening therein, said top opening being positioned opposite of said bottom opening, said top opening being generally centrally located between said first and second end walls;

a plurality of grommets being positioned in said peripheral wall adjacent to said bottom opening; and a plurality of cords extending through said grommets and extending across said width of said bottom opening.

2. The above ground propane storage tank covering device of claim 1, wherein said first and second end walls each have a generally circular shape.

3. The above ground propane storage tank covering device of claim 2, wherein each of said first and second end walls have a diameter generally between three feet and five feet.

4. The above ground propane storage tank covering device of claim 3, wherein said peripheral wall has a length from said first end wall to said second end wall generally between seven feet and ten feet.

5. The above ground propane storage tank covering device of claim 1, wherein said bottom opening has a generally rectangular shape and having a length greater than five feet and a width generally between two feet and four feet.

6. The above ground propane storage tank covering device of claim 1, wherein said top opening has a size and shape for selectively receiving a gauge and filling point of the propane storage tank.

7. The above ground propane storage tank covering device of claim 1, further including a resiliently elastic member being attached to and extending along a length of a peripheral edge of said bottom opening.

8. The above ground propane storage tank covering device of claim 1, further including a covering for selectively positioning over said top opening.

9. The above ground propane storage tank covering device of claim 8, wherein said covering includes a top wall and a perimeter wall being attached to and extending downwardly from said top wall, a fastening assembly removably fastens said perimeter wall to an edge of said top opening.

* * * * *